US005133257A

United States Patent [19]

Jonsson

[11] Patent Number: 5,133,257

[45] Date of Patent: Jul. 28, 1992

[54] IGNITION SYSTEM AND A METHOD FOR THE INITIATION THEREOF

[76] Inventor: Bert Jonsson, Skördevägen 42, S-713 00 Nora, Sweden

[21] Appl. No.: 460,892

[22] PCT Filed: Aug. 12, 1988

[86] PCT No.: PCT/SE88/00409

§ 371 Date: Feb. 13, 1990

§ 102(e) Date: Feb. 13, 1990

[87] PCT Pub. No.: WO89/01601

PCT Pub. Date: Feb. 23, 1989

[30] Foreign Application Priority Data

Aug. 14, 1987 [SE] Sweden ..... 8703157

[51] Int. Cl.[5] ..... F42C 11/02

[52] U.S. Cl. ..... 102/210; 102/207; 102/202.2; 102/201; 102/218

[58] Field of Search ..... 102/208, 209, 210, 207, 102/201, 202.13, 218, 202.2

[56] References Cited

U.S. PATENT DOCUMENTS

| | | | |
|---|---|---|---|
| 1,283,075 | 10/1918 | Chacon | 102/208 |
| 3,106,162 | 10/1963 | Wallbaum et al. | 102/210 |
| 3,323,459 | 6/1967 | Buffet | 102/207 |
| 3,340,811 | 9/1967 | Gauld | 102/210 |
| 3,438,326 | 4/1969 | Thomanek et al. | 102/210 |
| 3,589,294 | 6/1971 | Stresau | 102/210 |
| 3,987,729 | 10/1976 | Andrews et al. | 102/210 |
| 4,119,038 | 10/1978 | Allen et al. | 102/207 |
| 4,393,779 | 7/1983 | Brede et al. | 102/210 |

FOREIGN PATENT DOCUMENTS

| | | | |
|---|---|---|---|
| 0014401 | 6/1980 | European Pat. Off. | 102/210 |
| 1056970 | 5/1959 | Fed. Rep. of Germany | 102/209 |
| 1933377 | 2/1971 | Fed. Rep. of Germany . | |
| 2206646 | 8/1972 | Fed. Rep. of Germany | 102/210 |
| 137975 | 2/1978 | Norway | 102/210 |

*Primary Examiner*—Stephen Johnson

*Attorney, Agent, or Firm*—Pollock, Vande Sande & Priddy

[57] ABSTRACT

An apparatus for detonating explosive charges at a given location in response to an initiation at a remote location and after a preselected delay comprises a non-electrical initiation device for generating a non-electrical energy input by detonation or pyrotechnical combustion at the given location and initiated at the remote location, and an electrical igniter also at the given location responsive to the initiation device for time-delayed ignition of the explosive charge. The electrical igniter includes a transducer for generating an electrical output signal in response to the non-electrical energy input, an electronic variable time delay igniter in close proximity to the transducer for setting a preselected time delay and for generating a time delayed electrical output signal and an igniter also in close proximity to the electronic time delay means for initiating the ignition of the explosive charge. The transducer, the electronic time delay igniter, and the electrical the igniter are connected together by a first and a second pair of short electrical conductors constituting the only electrical conductors in the detonating apparatus, thereby minimizing the possibility of a spurious signal being generated in the electrical conductors.

14 Claims, 2 Drawing Sheets

IGNITION SYSTEM AND A METHOD FOR THE INITIATION THEREOF

TECHNICAL FIELD

The present invention relates to a method of initiating, i.e. starting, an electronically delayed ignition system for explosive charges, which is entirely protected from electromagnetic waves. The invention relates to a design of such shielded ignition system.

BACKGROUND OF THE INVENTION

In the employment of electric ignition systems for initiating explosive charges, nearby radio and radar stations, as well as other sources of radiation, constitute potential risks, since they could give rise to sufficiently powerful induced currents in the ignition wiring to cause accidental initiation of the charges. This is a serious drawback which is inherent in all electric ignition system and because of this drawback, in electrical ignition systems intended for military applications, it has been necessary to incorporate complex anti-disturbance systems, since, in field-service use it cannot be anticipated, as in civilian blasting operations using electrical ignition systems, that all use of radio, radar or other radiation transmitters in the vicinity of the explosion site can be prevented.

It has previously been common to provide electrically initiated blasting cartridges (blasting caps), when necessary, with pyrotechnical delay charges of conventional type. However, electronic delayed action igniters with very good performance as regards precise and well-known ignition intervals and small outside dimensions have recently become available at highly attractive prices.

These electronic delayed action igniters constitute a further argument in favor of choosing an electric instead of a non-electric ignition system in the initiation of explosive charges. However, as soon as an electric ignition system is employed in which the electric wires are of sufficient length to run the risk of induced currents in the wires, there will be the additional requirement of accurate and therefore also complex and expensive disturbance shielding of the entire ignition system.

Consequently, it would in many cases be desirable to have access to a non-electric ignition system which could occur the same exact time lag as the electronic time igniters and which could never be achieved using even the best pyrotechnical delay charge.

SUMMARY OF THE INVENTION

The present invention relates to a disturbance-shielded, electronically delayed ignition system for explosive charges in which the ignition system is initiated by detonation, or high-energy combustion, for instance of a pyrotechnical charge or the like, triggered in the immediate vicinity of the ignition system. According to one embodiment of the present invention, the initiating effect on the ignition system is achieved by means of a detonating fuze fired in its vicinity. The effect initiating the ignition system may then, in accordance with another embodiment of the present invention, be amplified by or replaced by, for instance, a slower burning pyrotechnical charge. According to the present invention, at least a portion of the energy generated on detonation or combustion is converted into electric current of sufficient power to energize an electronic time igniter which, in turn, initiates the desired detonation after a preset time interval.

By employing a detonating fuze such as a pentyl fuze or a low-energy fuze of the type which consists of a tube interiorly coated with a primary explosive for initiating the electrically delayed igniter, access will thus be created according to the present invention to an ignition system which is entirely free of disturbance in respect of induced currents in the ignition system, at the same time as the electronic delayed action, with its extraordinarily high precision, gives an ignition time precision which today is impossible to achieve by using time exclusively pyrotechnical igniters.

Detonating fuzes of the pentyl fuze type, or the low-energy fuze briefly described in the foregoing will, on firing, always give rise, to a greater or lesser extent, to both a shock wave and to heat and light generation. According to the present invention, all of these forms of energy may be utilized for initiating different embodiments of the igniter designed according to the present invention. The difference between these igniters lies in that different energy forms generated by the detonating fuze is utilized for initiating the electronic time igniter, and how this initiation is implemented. Other types of detonations or combustion giving rise to sufficient shock waves, light or heat generation may also be employed for initiation of the ignition system according to the present invention.

According to a first embodiment of the invention, use is made of the shock wave which, for instance, a detonating fuze generates to influence a proximally disposed piezoelectric transducer to generate an electric pulse which may charge a capacitor connected to the transducer to a sufficient voltage in order that this, in turn, discharge across an electronic delayed-action igniter interconnected therewith. The igniter, after a preset delay interval initiates through very short electric wires, a conventional electric igniter. All of the components included in this igniter embodiments are of a known type. Moreover, state-of-the-art technology makes it possible to miniaturize all the components, with the possible exception of the electric igniter. Since the miniaturized components require no other external supply of energy than the shock wave which is to activate the piezoelectric transducer, the entire igniter may advantageously be molded in some suitable plastic and be given a practicable outer configuration with, for example, a tunnel or groove for guiding a detonating fuze to sufficient proximity to the piezoelectric transducer. The electric igniter and its detonator (if any) may either be incorporated together with the other components in the thus obtained igniter body or be connected, in a conventional manner, with conductors which are sufficiently short that they could not be influenced by induced currents.

The above generally described igniter contains only very short electric conductors which may advantageously be grouped on a circuit board. This means that the risk of induced currents in the electric conductors may be disregarded. Consequently, the igniter according to the present invention will be completely free of disturbance by electromagnetic waves, and the like, from nearby radio or radar transmitters.

According to a second embodiment of the present invention, use is made of the heat generated by the detonating fuze to melt down, and thereby start, current emission from an electrolyte of the type which only emits current when the electrolyte is in the molten state but not when it is in the solid state. The current emitted by the molten electrolyte is now utilized to initiate the same type of electronic time igniter as that employed in conjunction with the first embodiment of the present invention. Also according to this second embodiment of the present invention, the entire igniter may be of extremely compact form, with the whole of the ignition system well encapsulated and entirely protected from disturbance by electromagnetic waves. When a detonating fuze is utilized to emit heat, the effect thereof may be amplified by an extra pyrotechnical charge.

The detonating fuze is suitably led through a channel or a groove through the igniter separated from the electrolyte by, for instance, a metal wall of good thermal conductivity and suitably also good thermal storage capacity so that the heat generated on detonation of the fuze may be utilized to maximum benefit in the electrolyte.

According to a third embodiment of the present invention, use is made of the light generated on detonation of the detonating fuze to act on a photocell which, in turn, starts an electronic time igniter of the same type as was employed in the previously-mentioned variants of the present invention. In this embodiment of the present invention, the needle flame formed on detonation of the fuze, possibly amplified by an extra pyrotechnical charge, may also be used to burn off a safety layer which wholly screens the photocell from all surrounding light up to the detonation of the fuze. The safety layer may, for instance, consist of an aluminium coating on a glass panel or glass lens which screens off the photocell and the electronic time igniter from the detonating fuze. In this embodiment, use may advantageously be made of a detonating low-energy fuze for the initiation.

Such a low-energy fuze can thus consist of a plastic tube interiorly coated with minor amounts of primary explosive, for example of the octogen type. In such a low-energy fuzes which are started by means of a normal detonating high-energy fuze, for example a pentyl fuze, the detonation wave follows the explosive coating along the interior of the tube. In this third embodiment, such a tubular low-energy fuze could thus be terminated by a conventional pyrotechnical charge which is defined by an aluminium-foil coated glass lens behind which the photocell and the electronic time igniter connected therewith are placed. Finally, the time igniter is connected by suitable means to a blasting cap or detonator of conventional type.

BRIEF DESCRIPTION OF THE ACCOMPANYING DRAWINGS

The present invention will now be described further with particular reference to the accompanying Drawings. In the accompanying Drawings.

DESCRIPTION OF PREFERRED EMBODIMENTS

Figure 1:
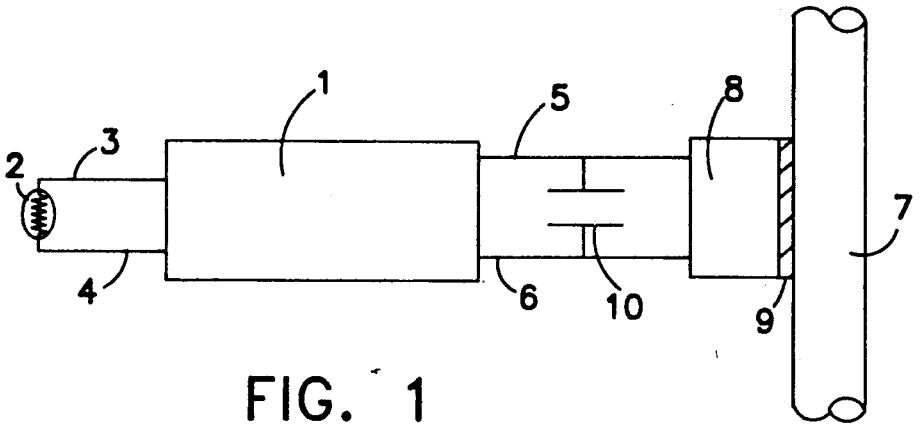
FIG. 1 shows a schematic section taken through a shock-wave initiated igniter variant.
Figure 2:
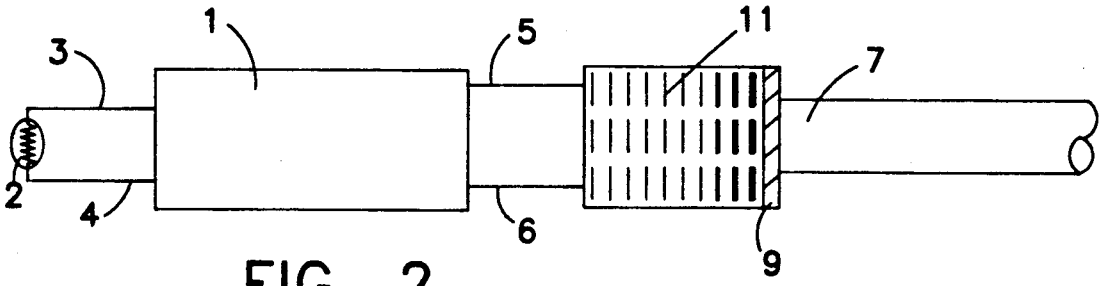
FIG. 2 is a schematic section of a thermally initiated igniter variant.
Figure 3:
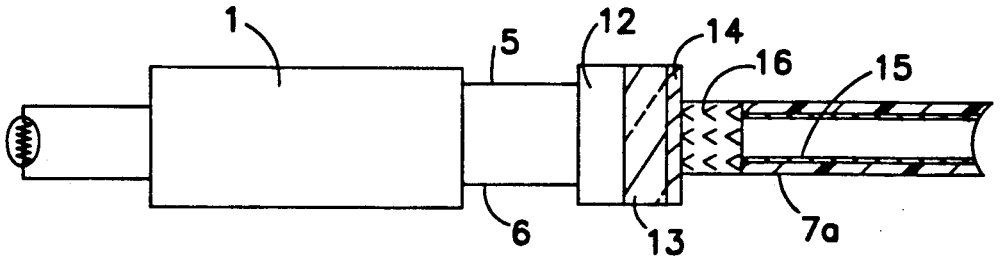
FIG. 3 is a schematic section of a light-initiated igniter variant.

Referring to the Drawings, the igniters illustrated in FIGS. 1, 2 and 3, which are made in accordance with the three different main embodiments of the present invention, all include a number of identical components, which have all been given corresponding reference numerals.

All igniters thus include an electronic time igniter 1. This, in turn, after a preset time interval after being itself is adapted initiated, to initiate the final ignition function. In the Figures, this final ignition function is marked by an electric ignition bead 2 supplied through leads 3 and 4. The final ignition function may, however, be elaborated in any other known manner, or even in accordance with hitherto unknown ignition technology, since this does not form a part of the present invention.

The ignition bead 2 shown in the Figures may, for example, be combined with a detonator of a known type. The time igniter, in turn, is started by a current which is supplied to the time igniter through 5 and 6 from a transducer which is capable of transforming at least parts of the energy generated on detonation in the vicinity of the transducer into an electric current.

Figure 4:
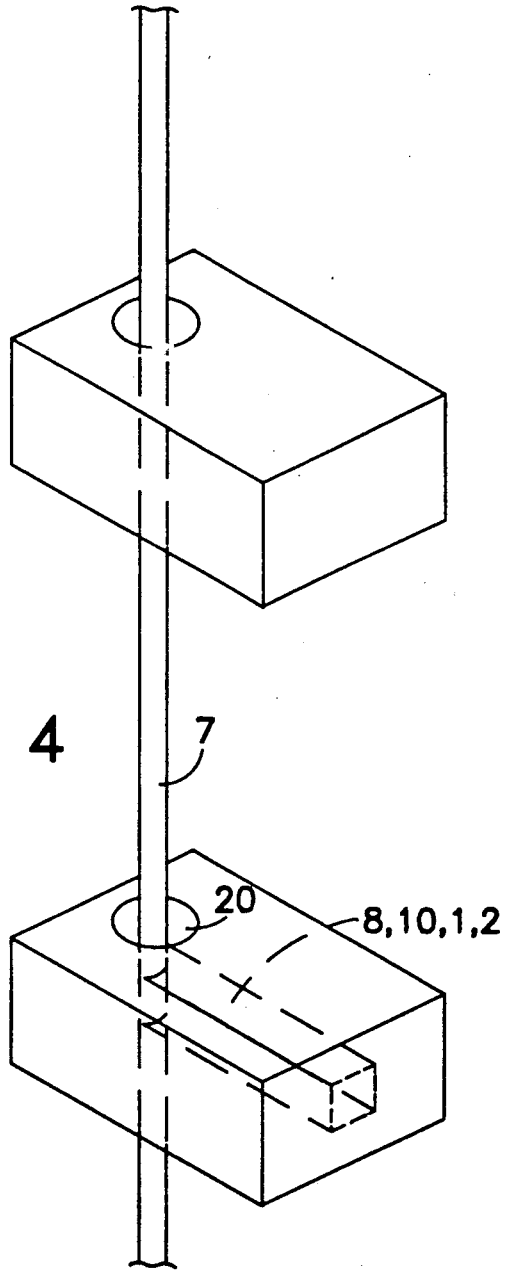
FIG. 4 shows a perspective view of the igniter shown in FIG. 1.

According to the embodiment shown in FIG. 1, the transducer which is to convert the detonation energy into an electric current is a piezoelectric transducer 8 disposed close to a detonatable fuze 7. A protective foil 9 is disposed between the transducer 8 and the fuze 7. When the fuze 7 is detonated, the transducer 8 receives a shock wave that generates an electric pulse which, in turn, charges a capacitor 10 which discharges across the time igniter 1, thereby starting the igniter. When the delay interval preprogrammed into the time igniter has expired, the time igniter initiates the ignition function 2. When the transducer is initiated by a detonatable fuze, this may either be drawn transversally past the transducer as shown in FIG. 1 and FIG. 4, or endwise to the transducer as in FIG. 2. Other detonating charges may also be employed to initiate the transducer.

In the embodiment illustrated in FIG. 2, use is made of the heat which is generated upon detonation of the fuze 7 to melt down an electrolyte disposed near the fuze 7, the electrolyte being of the type which emits battery current only in the molten state but not in its solid state at normal temperature. The electrolyte is designated 11. It is separated from the fuze by a protective wall 9 so as not to be burst and spread upon detonation of the fuze. From the electrolyte, two electric leads 5 and 6 run to the electronic clock 1. From the time igniter 1 and start thereof, all components and function are identical with the system according to FIG. 1.

In the embodiment of the present invention illustrated in FIG. 3, the time igniter 1 is started by a photocell 12 which is connected to the electronic time igniter 1 by means of leads 5 and 6. A protective lens of glass 13 is disposed between the photocell and the detonating fuze. This protective lens is, in turn, coated with a safety layer facing towards the fuze and consisting of a material which may be burnt off, in this particular case, an aluminium foil 14. This thus constitutes a safety function which effectively prevents all light from reaching the photocell 12. In the embodiment shown in FIG. 3, use is made of a detonating low-energy fuze of the type which consists of a plastic tube *7a* interiorly coated with a primary explosive charge 15. Since this does not possess sufficient combustion energy to burn off the protective layer 14, a special pyrotechnical charge 16 has been disposed in conjunction with the protective layer. The pyrotechnical charge 16 also serves to provide a longer light impulse so that the photocell will have time to react. The low-energy fuze 7*a* may be replaced by a pentyl fuze of normal quality.

When the fuze 7*a* detonates and the pyrotechnical charge 16 is combusted, the protective layer 14 will be combusted at the same time, the light generated by the flame influencing the photocell 12 which, via leads 5 and 6, starts the electronic time igniter which, after the preprogrammed time lag, thus initiates the ignition function 2 via ignition leads 3 and 4.

What we claim and desire to secure by Letters Patent is:

1. An apparatus for detonating at least one explosive charge at a given location in response to an initiation at a remote location and after a preselected time delay, said apparatus comprising:

a) non-electrical initiation means comprising means for generating a non-electrical energy input by detonation or by pyrotechnical combustion at said given location and initiated at said remote location; and b) an electrical igniting means also provided at said given location and responsive to said initiation means for time-delayed ignition of said explosive charge said electrical igniting means including:

1) transducer means for generating an electrical output signal in response to said non-electrical energy input;

2) an electronic variable time delay means in close proximity to said transducer means for setting a preselected time delay and for generating in response to said electrical output signal from said transducer means a time delayed electrical output signal whose signal delay corresponds to said preselected delay and is substantially independent of the magnitude of said electrical input signal from said transducer means;

3) igniter means also in close proximity to said electronic time delay means and responsive to the electrical output signal from said electronic time delay means for initiating the ignition of said explosive charge; and 4) a first pair of short electrical conductors for interconnecting the output of said transducer means with the input of said electronic time delay means and a second pair of short electrical conductors for interconnecting the output of said electronic time delay means with the input of the igniter means, said first and second pair of conductors constituting the only electrical conductors in said detonating apparatus;

whereby the initiation of the explosive charge requires the transmission of electrical signals over said short pairs of electrical conductors, said short pairs of electrical conductors thereby minimizing the possibility of a sperious signal being generated in said short pairs of electrical conductors which could result in the inadvertent detonation of the explosive charge.

2. An apparatus for detonation according to claim 1, wherein at least said transducer means and said electronic variable time delay means is made as a single, compact unit.

3. An apparatus for detonation according to claim 2, wherein said single unit further includes said igniter means.

4. An apparatus for detonation according to claim 2, wherein said means for supplying non-electrical energy input includes a plastic tube interiorly coated with a primary explosive and wherein a passage is provided in said electrical igniting means for running said detonation cord past said electrical igniting means, whereby said non-electric energy input is supplied to a further detonating apparatus.

5. An apparatus for detonation according to claim 4, wherein said transducer means consists of a piezoelectric transducer.

6. An apparatus for detonation according to claim 5, wherein said passage is disposed in the vicinity of the transducer means in the form of a channel for said detonating cord.

7. An apparatus for detonation according to claim 1, wherein said means for supplying non-electrical energy input includes a detonating cord and wherein a passage is provided in said electrical igniting means for running said detonation cord past said electrical igniting means, whereby said non-electric energy input is supplied to a further detonating apparatus.

8. An apparatus for detonation according to claim 1, wherein said transducer means consists of a piezoelectric transducer.

9. An apparatus for detonation according to claim 1, wherein said transducer means consists of a photocell.

10. An apparatus for detonation according to claim 1, wherein said transducer means consists of electrolyte which, in the solid state, emits no battery current but which is melted upon detonation and then emits sufficient current for initiating said electronic time delay means.

11. An apparatus for detonating at least one explosive charge at a given location in response to an initiation at a remote location and after a preselected time delay, said apparatus comprising:

a) non-electrical initiation means comprising means for generating and supplying non-electrical energy input by detonation or pyrotechnical combustion at said given location upon initiation at said remote location; and b) an electrical igniting means also provided at said given location for time-delayed ignition of said explosive charge responsive to said initiation means including:

1) transducer means for generating an electrical output signal in response to said non-electrical energy input;

2) an electronic variable time delay means in close proximity to said transducer means for setting a preselected time delay and for generating in response to said electrical output signal from said transducer means a time delayed electrical output signal whose time delay corresponds to said preselected delay and is substantially independent of the magnitude of said electrical input signal from said transducer means;

3) igniter means also in close proximity to said electronic time delay means and responsive to the electrical output signal from said electronic time delay means for initiating the ignition of said explosive charge;

4) a first pair of short electrical conductors for interconnecting the output of said transducer means with the input of said electronic time delay means and a second pair of short electrical conductors for interconnecting the output of said electronic time delay means with the input of the igniter means, said first and second pair of conductors constituting the only electrical conductors in said detonating apparatus, thereby minimizing the possibility of a sperious signal being generated in said short pair of electrical conductors which could result in the inadvertent detonation of the explosive charge; and 5) a passage means for said means for supplying non-electrical energy input provided in connection with said electrical igniting means for transmitting said non-electrical energy input past said electrical igniting means to further detonating apparatus.

12. An apparatus for detonation according to claim 11, wherein at least said transducer means and said electronic variable time delay means are made as a single, compact unit.

13. An apparatus for detonation according to claim 11, wherein said transducer means consists of a piezoelectric transducer.

14. A method for detonating at least one explosive charge at a given location in response to an initiation at a remote location and after a preselected time delay, said method comprising the steps of:

1) generating a non-electrical energy input by detonation or by pyrotechnical combustion at said given location, upon initiation at said remote location;
2) generating an electrical output signal in response to said non-electrical energy input by transducer means also provided at said given location;
3) setting a preselected time delay and generating, in response to said electrical output signal from said transducer means, a time delayed electrical output signal by an electronic variable time delay means in close proximity to said transducer means, said time delay corresponding to said preselected delay and being substantially independent of the magnitude of said electrical input signal from said transducer means;
4) initiating the ignition of said explosive charge by igniter means also in close proximity to said electronic time delay means in response to the electrical output signal from said electronic time delay means;
5) transmitting said electrical signals over a first pair of short electrical conductors between the output of said transducer means and the input of said electronic time delay means and over a second pair of short electrical conductors between the output of said electronic time delay means and the input of the igniter means, said first and second pair of short electrical conductors constituting the only electrical conductors in said detonating apparatus, whereby minimizing the possibility of a sperious signal being generated in said pairs of said electrical conductors which could result in the inadvertent detonation of the explosive charge; and
6) transmitting said non-electrical energy input past said transducer means through a passage formed in connection with said transducer means to another detonating apparatus.

* * * * *